United States Patent [19]

Kawano et al.

[11] 4,294,095

[45] Oct. 13, 1981

[54] PROCESS FOR FABRICATING HEAVY WALL TO PIPE

[75] Inventors: Tsuyoshi Kawano; Matsuo Usuda; Toshio Hirokawa, all of Kisarazu, Japan

[73] Assignee: Nippon Steel Corporation, Tokyo, Japan

[21] Appl. No.: 97,043

[22] Filed: Nov. 23, 1979

[30] Foreign Application Priority Data

Nov. 22, 1978 [JP] Japan ..... 53-143325
Feb. 23, 1979 [JP] Japan ..... 54-19750

[51] Int. Cl.[3] ..... B21D 5/00
[52] U.S. Cl. ..... 72/51; 72/368; 72/389; 72/473; 72/478
[58] Field of Search ..... 72/51, 368, 473, 478, 72/386, 389

[56] References Cited

U.S. PATENT DOCUMENTS

| | | | |
|---|---|---|---|
| 737,989 | 9/1903 | Wolfe | 72/51 |
| 2,825,385 | 3/1958 | Allen | 72/478 X |
| 3,466,919 | 9/1969 | Bledstein | 72/389 |
| 3,802,239 | 4/1974 | Karmann et al. | 72/51 |
| 3,844,156 | 10/1974 | Hanni et al. | 72/473 X |

*Primary Examiner*—Frank T. Yost
*Attorney, Agent, or Firm*—Wenderoth, Lind & Ponack

[57] ABSTRACT

Rolled steel plate is press-fabricated into cylindrical UO pipe with a large wall thickness, by the steps of crimping, U-ing and O-ing. In the U-ing process, a collapsible U-ing punch, including a center block carrying paired side punches on both sides and a bottom punch at the bottom, is used. The U-ing punch insures that the O-shaped workpiece has the desired butt gap by decreasing the ratio of its height to its width when the gap proves to be smaller than the desired butt edge gap, and vice versa when the gap proves to be larger than the desired butt edge gap.

10 Claims, 16 Drawing Figures

| MARK | SYMBOL | PIPE DIA. | PLATE THICKNESS | YIELD POINT | 2(B+t)/D |
|---|---|---|---|---|---|
| × | A | 1219.2mm | 25.4mm | 52.4kg/mm² | 0.833 |
| • | B | 1219.2mm | 32.0mm | 53.5kg/mm² | 0.844 |
| ○ | C | 1219.2mm | 38.0mm | 31.5kg/mm² | 0.854 |
| △ | D | 1422.4mm | 38.0mm | 32.1kg/mm² | 0.732 |

| MARK | SYMBOL | PIPE DIA. | PLATE THICKNESS | YIELD POINT | PUNCH HEIGHT |
|---|---|---|---|---|---|
| ○ | E | 1219.2mm | 38.0mm | 31.5kg/mm² | 304.8mm |
| • | F | 1219.2mm | 38.0mm | 27.0kg/mm² | 304.8mm |

PROCESS FOR FABRICATING HEAVY WALL TO PIPE

BACKGROUND OF THE INVENTION

This invention relates to a fabricating process for the manufacture of heavy wall UO pipe, and more particularly to a process for fabricating plates having a thickness of 19 mm and greater.

The UO process is a typical pipe manufacturing process using electric welding to join the edges of a plate bent into a circular cross-section. This process comprises crimping or edge-planing the steel plate or workpiece, which is then shaped into a U-shaped cross-section, shaped into an almost closed circle by the O-ing press, welded, and finished to the desired shape and size by expanding or contracting.

Recently steel pipes with greater wall thickness and higher tensile strength, such as those having a wall thickness of 19 mm or more and conforming to API standard (specifying a yield point of 45.6 kg/mm$^2$ and above) or higher, have come to be required.

Despite its high production rate, the UO process involves the following problems in fabricating heavy wall pipes:

(1) Excessive Peaking after O-ing

Inadequate bending by the O-ing press develops peaking or butt projection 4 on the O-shaped workpiece 3, as shown in FIG. 1. The amount of peaking, which appears as out of roundness, as seen in FIG. 1) tends to grow excessive especially on heavier wall pipes. This peaking 4 remains after welding. Even expanding cannot fully remove the peaking on heavier wall pipes, resulting in ill-shaped products. Excessive peaking causes a large bending moment during expanding, which exerts heavy strain in the vicinity of the weld and therefore reduces the toughness of the pipe.

(2) Inadequate circular shape after O-ing

From time to time, the O-ing operation fails to give a satisfactorily circular cross section to the workpiece, making its diameter greater than desired in one part and smaller in another, or making it look like an ellipse. This out of roundness can be corrected to a considerable extent by applying a greater expanding force. But the intensified expansion is undesirable because it entails increased strain, causing deterioration of toughness. The expander power must be increased, too.

(3) Increase in O-ing press power

In principle, the above problems (1) and (2) can be solved by increasing the power of the O-ing press to apply adequate compressive strain during the O-ing process. This solution, however, calls for a huge O-ing press power. The inventors have found that O-ing 38 mm thick steel plate of API X-70 class steel into a 48-in. (1219 mm) dia. pipe requires a load of approximately 3800 tons per meter of length. Accordingly, fabrication of 18 m long pipe requires an O-ing press power of approximately 70,000 tons. Such a huge press is commercially unavailable. Even if it were available, it would be prohibitively costly.

The crimped plate is first subjected to the U-ing and then to the O-ing operations. The butting edges of the O-shaped workpiece are tack-welded. The clearance $\delta$ (hereinafter called the gap) between the edges of the O-shaped workpiece 3, shown in FIG. 1, has a great influence on welding efficiency and weld quality. When no gap is left, foreign matter (dust, oil, etc.) left between the edges results in poor welding. When the gap is too large, weld crack and other defects increase. To avoid these problems, a tack welding machine is commonly provided with a mechanism to forcibly produce a gap before welding and an external restraining mechanism to forcibly reduce the gap to zero when proceeding with the welding. With heavy wall pipes, however, the load on these mechanisms becomes extremely large since it increases in proportion to the square of plate thickness. The load thus created is too large for the conventional mechanisms to bear. Consequently, welding efficiency and weld quality are impaired. Providing an appropriate gap after O-ing is clearly important and effective for the increase of welding efficiency and product quality. Especially in the manufacture of pipes with a wall thickness of 19 mm and heavier, the necessity of gap control becomes extremely important, and the permissible tolerance for the desired gap extremely limited. For wall thickness of 25.4 mm and heavier, gap control is indispensable.

This gap varies in a complicated way with the workpiece properties, especially thickness and strength, and the O-ing conditions, especially the O-ing load. The following are typical known gap control methods:

(a) To provide a key on the top O-ing die so that fabrication is performed with the key held between the butting edges.

(b) To control the O-ing load.

(c) Combination of (a) and (b).

All these methods control the gap by modifying the O-ing conditions. But as a practical matter they are inapplicable to the heavy wall pipes, the manufacture of which constitutes the object of this invention, for the following reasons:

(i) The heavy wall pipes will probably break the key employed by the method (a).

(ii) The O-ing operation is required to form the workpiece close to a true circle. This requirement calls for a large enough O-ing load. Meanwhile, the gap has a general tendency to decrease with an increasing O-ing load and plate thickness. Accordingly, in the manufacture of the heavy wall pipes, the method (b) has little or no freedom to harmonize the requirement for fabrication of the workpiece with as little out-of-roundness as possible, i.e. the application of a sufficiently large O-ing load, with the requirement for providing an appropriate gap, i.e. a limitation of the O-ing load. To increae this freedom, the O-ing press capacity must be increased to a great extent, which entails great impairment of O-ing efficiency.

(iii) With the narrowing gap tolerance limits for the heavy wall pipes, none of the above-described methods can satisfy varying requirements for different material plate thicknesses and strengths and pipe diameters.

SUMMARY OF THE INVENTION

This invention solves the aforementioned problems in the fabrication of heavy wall UO pipes.

An object of this invention is to provide a heavy wall UO pipe fabricating process that can be accomplished with great commercial ease and high efficiency, bringing the butt edge gap of the workpiece within the tolerance limits irrespective of plate thickness and strength and pipe diameter.

Another object of this invention is to provide a heavy wall UO pipe fabricating process that permits efficient bending for reducing the width of the underformed edge zone left after crimping with a small fabricating force and forming of a satisfactory groove shape after O-ing.

Yet another object of this invention is to provide a heavy wall UO pipe fabricating process that permits performing O-ing with a small fabricating load.

To achieve the above-described objects, the heavy wall UO pipe fabricating process according to this invention comprises crimping, U-ing and O-ing flat steel plate into cylindrical pipe. The U-ing process is accomplished by the use of a collapsible U-ing punch which comprises a center block carrying paired side punches on both sides and a bottom punch at its bottom. The U-ing punch insures that the O-shaped workpiece has the desired butt gap by decreasing the ratio of the height to the width when the gap proves to be smaller than the desired butt edge gap, and vice versa when the gap proves to be larger than the desired butt edge gap.

The process of this invention can easily control the gap width to the desired value, over a wide range of plate thickness and strength and pipe diameter. In addition, unlike the conventional processes, it does not require the modification of the O-ing conditions, which, therefore, can be fixed at those which insure the highest degree of pipe roundness. Such O-ing conditions result in good pipe shape and high fabrication efficiency. Accordingly, this invention has a great commercial value in a process for the the manufacture of heavy wall pipes which calls for exact gap control.

According to this invention the workpiece, other than at its edges, is kept out of contact with the bottom die from the start to completion of crimping.

This feature permits reducing the width of the undeformed edge zone, which in turn reduces the amount of peaking and insures good pipe shape. In addition, it does not require great fabricating force. All this makes the process of this invention highly advantageous for the manufacture of heavy wall pipes.

BRIEF DESCRIPTION OF THE DRAWINGS

FIG. 4 shows a crimping process with an ordinary bottom die. FIG. 5 is similar to FIG. 4, except that the workpiece is upheld by a support. FIG. 6 shows a crimping process employing a narrower bottom die.

FIG. 7 shows a crimping process using a narrower bottom die. FIG. 8 is similar to FIG. 7, except that the workpiece is upheld by a support.

FIG. 10(a) shows a one-piece U-ing punch, and FIG. 10(b) an integral U-ing punch.

FIG. 11(a) shows a U-ing punch with reduced height, and FIG. 11(b) the same U-ing punch with increased height.

DETAILED DESCRIPTION OF THE PREFERRED EMBODIMENTS

By detailed study of the UO pipe fabricating process involving the crimping, U-ing and O-ing steps, the inventors have discovered that the O-ing load and the form of the O-shaped workpiece depend largely on the shape of the workpiece before O-ing. Particulars of what has been found are as follows:

(1) Crimping conditions have a great effect on the O-ing load and the form of the O-shaped workpiece (especially on the amount of peaking p and gap $\delta$). Specifying the crimping conditions permits producing, with a low load, an O-shaped workpiece with minor peaking (entailing minor expanding or contracting strain, and minor peaking after correction) and adequate gap.

(2) Specifying the U-ing conditions, in addition to the crimping conditions, permits producing, with a low load, a satisfactorily O-shaped workpiece with little out-of-roundness and entailing minor expanding or contracting strain. It insures an adequate gap and permits controlling the gap width as desired.

Figure 1:
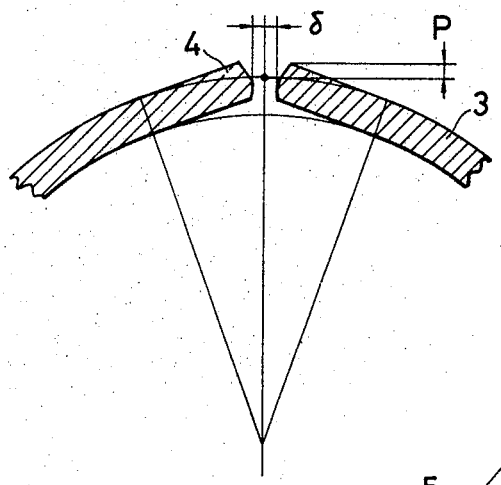
FIG. 1 PRIOR ART
FIG. 1 is a cross-sectional view showing an example of the O-shaped workpiece.
Figure 2:
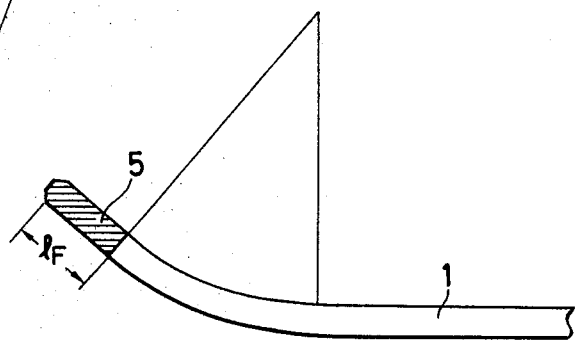
FIG. 2 illustrates the undeformed edge zone in the workpiece.

This invention is based on the above-described finding. In the crimping operation, to begin with, only a limited width of the extremity 5 of the workpiece edge remains undeformed (this extremity hereinafter being called the undeformed zone). Conventionally, due to insufficient O-ing press power, this undeformed zone 5 on heavy wall pipes has not been corrected in the subsequent O-ing operation, which is a main cause of peaking. As the width $l_F$ of this undeformed zone (the distance from the groove edge on the external surface of the pipe, as shown in FIG. 2) increases, the amount of peaking on the workpiece increases. Any peaking that is too large to be corrected by expansion or contraction not only impairs the shape of the product pipe but also reduces its toughness because of the large strain developed near the weld during correction. Unremoved peaking on the finished pipe reduces its breaking strength, damaging its geometric balance. Therefore, the amount of peaking on the O-shaped workpiece should preferably be reduced to a minimum by reducing the width $l_F$ of the undeformed zone. More specifically, the width $l_F$ of the undeformed zone should preferably be kept within the limit expressed as $$\frac{D}{2}\tan\left(\cos^{-1}\frac{D}{D+5}\right),$$

where D=outside diameter of the pipe in mm. When the width of the undeformed zone exceess this limit, the object of this $l_F$ invention to obtain by at least a 20 percent lower O-ing load than is conventional a workpiece having a good shape, especially in respect of peaking, equivalent to one from a conventional O-ing operation, is unattainable. The resulting peaking on the O-shaped workpiece, exceeding 2.5 mm, leads to production of ill-shaped pipe. The smaller the width $l_F$ of the undeformed zone, the better will be the form of the O-shaped workpiece, and the less the strain developing near the weld during expansion or contraction. Therefore, the smaller undeformed zone width is preferred for the fabrication of heavy wall pipes that are required to have good low-temperature toughness. It is therefore preferable, especially when a still lower O-ing load is desired, to keep the width $l_F$ of the undeformed zone within $$\frac{D}{2}\tan\left(\cos^{-1}\frac{D}{D+3.5}\right).$$

Figure 3:
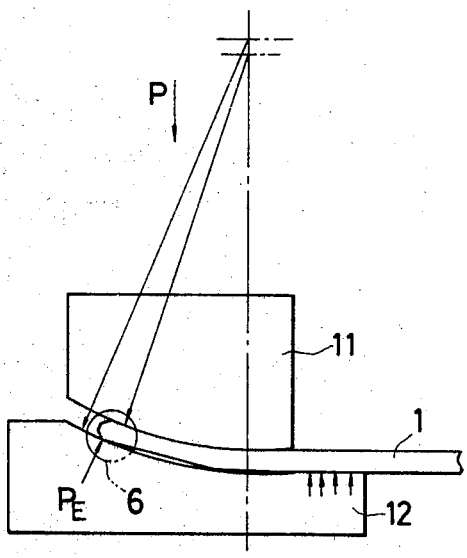
FIG. 3 PRIOR ART
FIG. 3 illustrates a conventional crimping process.
Figure 4:
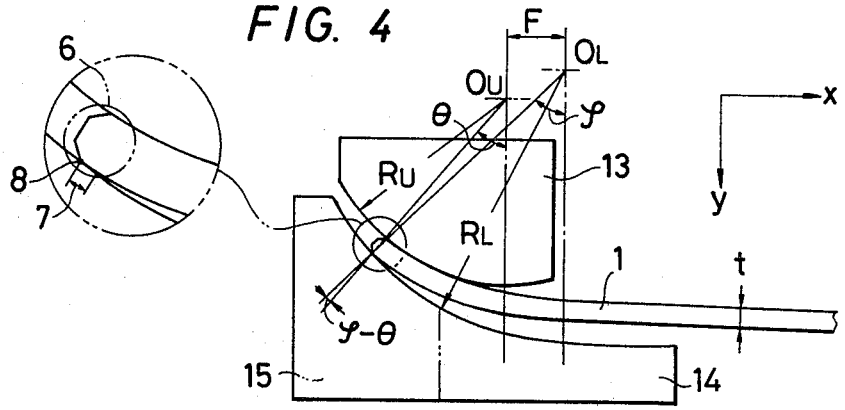
FIGS. 4 through 6 illustrate embodiments of the crimping process according to this invention, each being an end view that shows the workpiece edge being crimped between a top die and a bottom die the working surface of which has a greater radius of curvature than the top die.

The new crimping process according to this invention differs from the conventional ones. FIG. 3 schematically shows a conventional crimping process. FIG. 4 shows an embodiment of the crimping process according to this invention. In the conventional crimping operation, as shown in FIG. 3, the workpiece 1 contacts the bottom die 12 at many points, whereby the crimping load P applied by the top die 11 is dispersed. Consequently, the force $P_E$ working on the workpiece edge 6, which is necessary for reducing the width $l_F$ of the undeformed zone, decreases. This is a waste of fabricating load.

By contrast, the crimping process according to this invention employs dies which are designed to keep the workpiece 1 out of contact with the bottom die 14 from the start to completion of crimping, except in a small area 7 where the workpiece edge 6 contacts the bottom die 14, as shown in FIG. 4. Hereinafter, this new crimping process is called one-point contact crimping. Consequently, the crimping load concentrates in the contact area 7 of the workpiece edge 6 and the bottom die 7, permitting efficient reduction of the width $l_F$ of the undeformed zone. In other words, the same width of the undeformed zone can be obtained with less crimping load. Crimping load is substantially inverse in proportion to the width of the undeformed zone, and in proportion to the square of the plate thickness. Therefore, crimping for pipes having a wall thickness greater than 19 mm, which are produced by the method which is the object of this invention, normally require a huge press power. In addition, this invention makes it a condition for the production of good workpiece shape by a low O-ing load that the width of the undeformed zone resulting from crimping be reduced to a minimum. This requirement would normally require a still greater crimping press power. Therefore, the use of this new one-point contact crimping, capable of reducing crimping load by approximately 30 percent, is indispensable to this invention.

FIGS. 4 through 8 show embodiments of the one-point contact crimping according to this invention.

To perform this one-point contact crimping the dies should be such that the edge 6 of the workpiece 1 is constantly kept in contact with the bottom die 14, 15 or 16 and in close contact with the top die 13 even at the extreme degree of crimping, i.e., when $l_F=0$. To satisfy this requirement, a relationship $\phi-\theta=0$ must be established between $\phi$, an angle formed between a line connecting the center of curvature $O_L$ of the bottom die 14, 15 or 16 and the tip 8 of the contact area 7 and a vertical axis, and $\theta$, an angle formed between a line connecting the center of curvature $O_U$ of the top die 13 and the tip 8 of the contact area 7 and a vertical axis, hereinafter called the winding angle. At the same time, the workpiece 1 should be kept out of contact with the bottom die 14, 15 or 16 from the start to completion of crimping, except at the contact area 7 where the workpiece edge 6 contacts the bottom die 14, 15 or 16. This is readily achieved by suitably selecting $R_U$ and $R_L$, the amount of offset F between the centers of curvature $O_U$ and $O_L$ of the top and bottom dies, and the length of the bottom die. The radius of the top die $R_U$ depends on the diameter of pipe desired, thickness and strength of material plate, etc. A favorable radius is $$R_U=\left(\frac{D}{2}-t\right)\times(0.65\sim 0.9),$$

where D = outside diameter of pipe (mm), and t = thickness of material plate (mm), and the radius of the bottom die $R_L$ depends on $R_U$.

Figure 7:
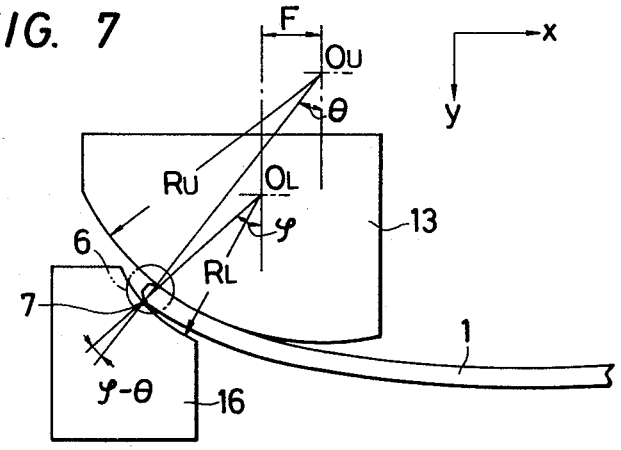
FIGS. 7 and 8 illustrate further embodiments of the crimping process according to this invention, both being an end view that shows the workpiece edge being crimped between a top die and a bottom die the working surface of which has a smaller radius of curvature than the bottom die.
Figure 8:
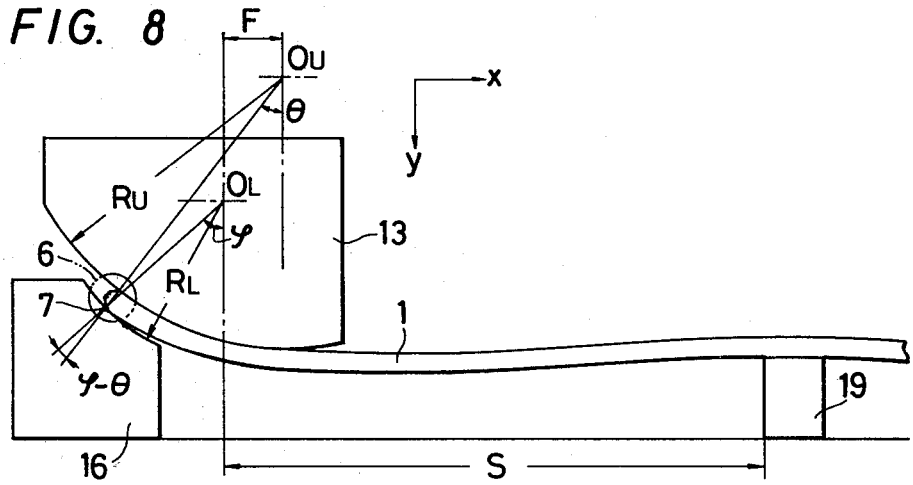

FIGS, 4 through 6 show the cases in which the radius of the bottom die $R_L$ is not smaller than that of the top die $R_U$. FIGS. 7 and 8 show the cases in which the radius of the top die $R_U$ is larger than that of the bottom die $R_L$. Where $R_L \geqq R_U$, the workpiece 1 rarely contacts the bottom die 14, except at the contact area 7. The probability of contact, if any, can be eliminated by using a short bottom die 15, or providing a support 19 near the center of the width of the workpiece so as to support the workpiece 1 to bring the upper surface of its edge in contact with the top die 13. Preferably, the distance S between the support 19 and the lowest point of the top die 13 must not be smaller than 300 mm so that the force working on the support 19 will not disperse the crimping load. This makes the dispersion of the crimping load negligible, so that crimping as efficient as that for a supportless operation can be achieved.

The use of the support is preferred because it permits the workpiece to be efficiently wound around the top die. The support may be replaced by a conveyor roller or other device that can produce a similar effect.

Where $R_U > R_L$ as shown in FIGS. 7 and 8, a short bottom die 16 is used to avoid the contact of the workpiece 1 therewith, except at the contact area 7. The use of the support 19, as shown in FIG. 8, is preferred here, too.

Figure 5:
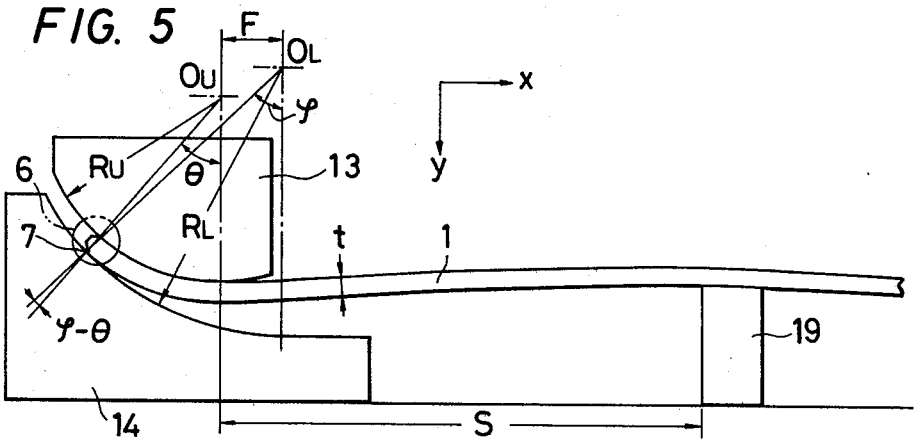
Figure 6:
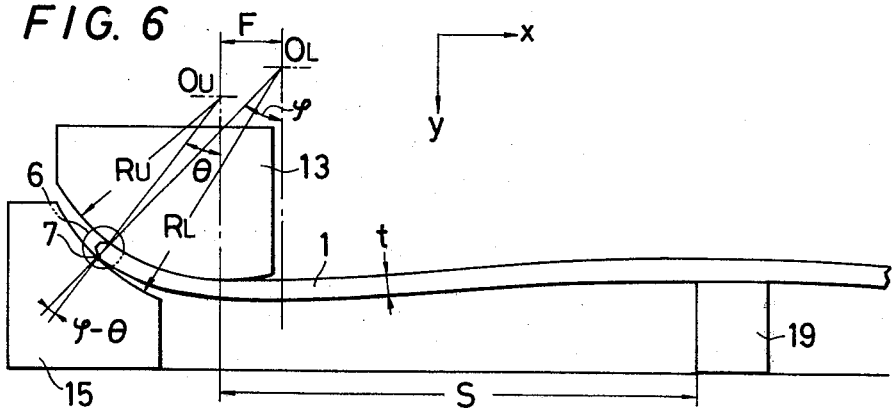

The above-described one-point contact crimping is easier to carry out when $R_L \geqq R_U$ as shown in FIGS. 4 through 6. In this case, $R_L$ may be infinite, i.e. the die may be straight ($R_L=\infty$).

If $\phi-\theta$ is too large, the groove for welding may be damaged by the bottom die 14, 15 or 16 and hamper the welding operation. Preferably, therefore, $\phi-\theta \leqq 15°$.

As will be discussed later, the use of the one-point contact alone can reduce the crimping load by approximately 30 percent.

Figure 9:
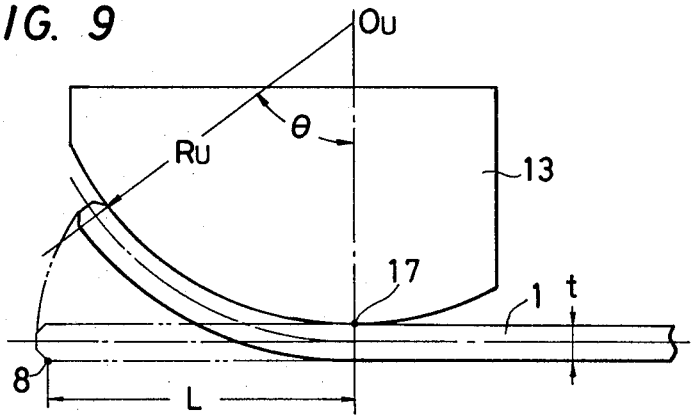
FIG. 9 illustrates the width of the workpiece edge that is being crimped.

Also preferable is that the length L of the workpiece to be crimped be specified. Here, the crimping length L is defined to extend between the lowest point 17 of the top die 13 and the extreme end 18 of the workpiece, as shown in FIG. 9. If the radius of the top die is $R_U$, $$L = \left(R_U + \frac{t}{2}\right) \times \frac{n\theta}{180}$$

where Θ = winding angle (degree). This equation shows the close relationship between the crimping width L and the winding angle $\theta$.

The crimping width L or winding angle $\theta$ has an important effect on the form of the O-shaped workpiece. It has been known that an increase in the crimping width makes possible the production of good-shaped workpieces with a low O-ing load.

With increasing crimping width L, as discussed later, (1) out-of-roundness of the workpiece decreases, (2) the workpiece edge gap increases, and (3) the crimping efficiency increases, with the width of the undeformed zone and the amount of peaking decreasing. It has been experimentally established that the aforementioned effects can be obtained if $L \geqq 0.05\pi(D-t)$. If L is smaller, the influence of the afore-mentioned shape and operation efficiency improving effects drop sharply, failing to decrease the O-ing load. The greater the crimping width L, the greater will be the influence of the effects. Beyond a certain point, however, the effects will become saturated, i.e. will not increase. The preferable range is $L=(0.06\text{–}0.10)\pi(D-t)$. This value is more than 1.5 times the conventional crimping width.

There will next be described in the U-ing of the workpiece thus crimped.

The basic principle of this invention is to control the gap in the O-shaped workpiece by controlling the ratio H/2B by varying the punch height H and/or the punch width 2B. The O-ing conditions are substantially fixed at conditions which are suited for attaining the best pipe roundness. Under these conditions, the gap width is controlled to insure high fabrication efficiency, good product shape, and convenience for the welding operation.

When the ratio H/2B is reduced, the gap in the O-shaped workpiece increases, and vice versa, although the relationship depends on the thickness of the plate and strength of the material to some extent. Therefore, the punch height H and/or the punch width 2B is determined by controlling the ratio H/2B so as to obtain the desired gap, giving consideration to the material thickness and strength.

Figure 10A:
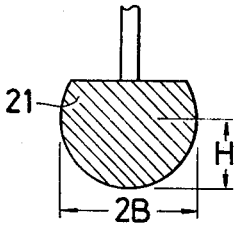
FIG. 10(a) PRIOR ART
FIGS. 10(a) and 10(b) show the cross-section of conventional U-ing punches.
Figure 10B:
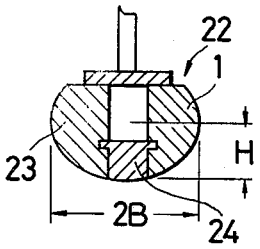
FIG. 10(b) PRIOR ART

FIGS. 10(*a*) and (*b*) show two examples of a conventional U-ing punch. FIG. 10(*a*) shows a one-piece U-ing punch 21, while FIG. 10(*b*) shows an integral U-ing punch 22 comprising side punches 23 and a bottom punch 24. These conventional punches cannot change the punch height H and/or punch width 2B.

The U-ing punch according to this invention differs from the conventional ones in that it can change the ratio H/2B, by changing the punch height H and/or punch width 2B, depending on the material thickness and strength and the pipe diameter, as shown in FIGS. 11(*a*) and 11(*b*) wherein the punch height in FIG. 11(*b*) shown as being changed from that in FIG. 11(*a*). Here, 2B denotes the width of the U-ing punch, and H designates the height of the U-ing punch measured from the point corresponding to the maximum punch width, which in the case of FIG. 11 corresponds with the center of curvature of a side punch 32.

The U-ing punch shown in FIGS. 11(*a*) and 11(*b*) will now be described in detail. Comprising side punches 32, a bottom punch 33, a center block 34, a height adjusting block 35, etc., the U-ing punch 31 can change the height H and/or width 2B, as discussed in further detail later. Rocker type dies 46 support the workpiece 2 from both sides. FIG. 11(*a*) shows a case in which H/2B is reduced to minimum to increase the size of the gap. In this case, the workpiece 2 is bent along the side punches 32, with the bottom punch 33 not participating in the U-ing operation. The U-shaped bottom of the workpiece 2 is produced by a uniform bending moment that develops when the workpiece is bent by the side punches 32. FIG. 11(*b*) shows a case in which H/2B is increased to reduce the size of the gap, by inserting a height adjusting block 35 between the center block 34 and the bottom punch 33. In this case, the workpiece 2 is bent first by the bottom punch 33, then by the side punches 32.

The gap in the pipes having a wall thickness of 19 mm (preferably 25.4 mm) or heavier generally tends to be small. It is therefore preferred to limit the shape of the U-ing punch. This requirement is expressed as:

$$0.65 \leqq 2(B+t)/D \leqq 0.93 \quad (1)$$

where 2B = punch width (mm), D = desired pipe diameter (mm), and t = material plate thickness (mm).

The upper limit 0.93 in equation (1) is determined by the geometric condition governing the delivery of the U-shaped workpiece into the O-ing press. When this limit is exceeded, the workpiece cannot be delivered into the O-ing machine. Below the lower limit 0.65, an O-shaped workpiece with a large wall thickness has little or no gap, even if H/2B is made small. Or the change of H/2B provides little or no gap control margin. The best result is obtained when $0.70 \leqq 2(B+t)/D \leqq 0.90$.

With respect to the U-ing operation described above, it is further preferred to satisfy the following conditions:

To begin with, when changing the punch height H, it is preferred to establish the following relationship with regard to the width of the punch height adjusting section $2A{:}0.22 \leqq 2A/2B \leqq 0.42$. The larger the ratio 2A/2B, the greater the margin for gap control. An increased 2A/2B, however, results in a decrease in the radius $R_1$ of the side punch 32, which, in turn, entails an increase in the U-ing load, i.e. the straight portion contacting the side punch 32 and bottom punch 33 [see FIG. 11(*b*)], and, therefore, out-of-roundness of the O-shaped workpiece. This is the reason why the upper limit of 0.42 is set.

When 2A/2B is smaller than 0.22, the gap control margin becomes too small to permit effective fabrication of plates of varying thickness and strength into pipes of varying diameter according to this invention. This explains the selection of 0.22 as the lower limit. The best result is obtained when 2A/2B = 0.24–0.40.

As mentioned previously, this invention controls the ratio H/2B, by changing the punch height H and/or punch width 2B, to obtain the desired gap width in the O-shaped workpieces of various wall thicknesses and strengths. The increased H/2B entails a decrease in the gap, and vice versa. In designing the U-ing punch for the process of this invention, the extent to which the maximum and minimum values of H/2B can be adjusted constitutes an important factor. The inventors discovered the following facts, as a result of many experiments made by using various U-ing punches satisfying equation (1) in the fabrication of plates of various thicknesses and strengths into pipes of various diameters.

(a) The minimum value or lower limit of the ratio H/2B, obtained by changing the punch height H and/or punch width 2B, should not be smaller than 0.28. Smaller values of H/2B make possible obtaining a larger gap. But one of the objects of this invention is to provide an appropriate gap. Excessive gap size is detrimental to the efficiency of the O-ing operation. Efforts to reduce the gap call for a large O-ing load. To reduce the minimum value or lower limit of H/2B, the radius of the side punch 32 must be decreased, which, however, increases the U-ing load and lowers the fabrication efficiency. Considering the object of this invention, the minimum value of H/2B should preferably be such that the smallest gap resulting from a certain combination of plate thickness and strength and pipe diameter is large enough to meet the desired gap requirement. For this reason, 0.28 was selected as the minimum value of H/2B suited for the fabrication of heavy wall UO pipes.

(b) The maximum value upper limit of the ratio H/2B is set at 0.45. If H/2B exceeds 0.45, the gap in the O-shaped workpiece becomes smaller than desired, leaving little gap control margin for pipes of different thicknesses and strengths.

In fabricating heavy wall UO pipes of different thicknesses, diameters and strengths, H/2B is adjustable between the maximum and minimum values thus established. When the range of the pipe wall thickness, diameter and strength is smaller, the range of H/2B can be reduced by making the minimum value of H/2B larger than 0.28 and the maximum value smaller than 0.45. To obtain the best result in the fabrication of ordinary heavy wall UO pipes, the minimum and maximum values (lower and upper limits) of H/2B should preferably be 0.30 and 0.43, respectively.

As long as the above-described condition is satisfied, the shape of the side punch 32 and the bottom punch 33 requires no particular limitation. As shown in FIGS. 11(*a*) and 11(*b*), the arc expressed as $R_1/D$ and $R_2/D$ may fall between 0.2 and 0.35, as in a conventional U-ing punch. The curvature may be suitably selected, too. It is also preferred to round both edges of the bottom punch 33 to a radius smaller than the radius $R_2$ of the principal portion thereof so that the side punch 32 and the bottom punch 33 have a common tangential line even when H/2B is large.

To determine the punch height H and punch width 2B, interrelationships of the gap $\delta$ and the pipe diameter, thickness and strength of material plate, O-ing load, punch height H and width 2B should be established beforehand, either experimentally or theoretically. The punch height H and width 2B are finalized based on these data, taking into account the specifications of the pipe to be actually fabricated.

Figure 11A:
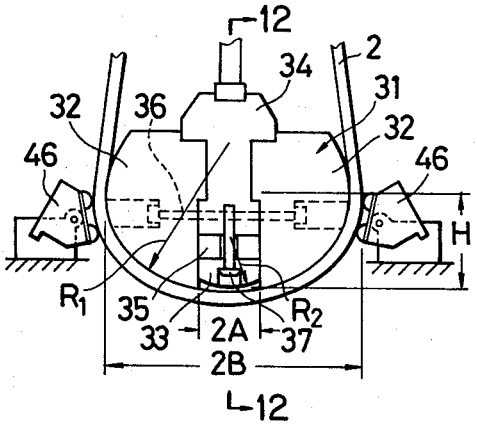
FIGS. 11(a) and 11(b) are cross-sectional views showing equipment used for the U-ing operation according to this invention.
Figure 11B:
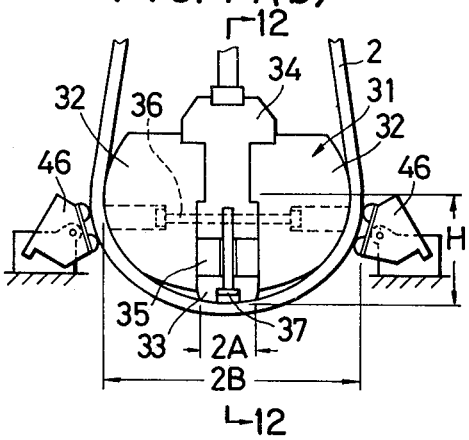
Figure 12:
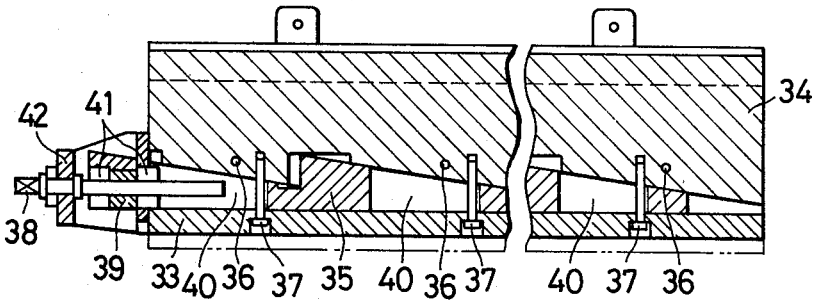
FIG. 12 is a cross-sectional view taken along the line 12—12 of FIGS. 11(a) and 11(b)

Now an embodiment of the device for adjusting the punch height H and/or punch width 2B will be described. As shown in FIGS. 11(*a*) and 11(*b*), the side punches 32, holding the height adjusting block 35 and bottom punch 33 therebetween, are fastened to the center block 34 with a bolt-nut combination 36. The bottom punch 33 is fastened to the center block 34 with a vertical bolt 37 extending through the height adjusting block 35. By increasing the bolts 37 to a given position and moving the height adjusting block 35 to the right in FIG. 12 by means of a screw 38 rotatably held by a stand 42, the bottom punch 33 can be lowered and fixed in position. The bottom punch 33 can also be elevated from the lower position and fixed in position by slightly unscrewing the bolts 37, moving the height adjusting block 35 to the left in FIG. 12 by the screw 38, then screwing the bolts 37 in. As shown in FIG. 12, the upper surface of the height adjusting block 35 consists of a plurality of inclined planes, which permits providing a greater angle of inclination and, therefore, adjusting the vertical position of the bottom punch 33 within a greater range. Provided with a clearance 40, the height adjusting block 35 can move clear of the bolts 37. In this embodiment, provision is made to move the height adjusting block 35 together with the bottom punch 33. As shown in FIG. 12, the height adjusting block 35 has a recess in the center of the front end (left end in FIG. 12), in which a square nut 39 is fitted to engage with the screw 38. Held between both walls of the recess, the square nut 39 is not permitted to turn. The height adjusting block 35 is moved by the rotation of the screw 38. A clearance 41 is provided to allow the vertical motion of the height adjusting block 35 due to said movement.

In this embodiment, the vertical position of the bottom punch 33, held between the side punches 32, is adjusted by means of the height adjusting block 35 that is moved by the screw 38 and fixed by the bolts 37. But this invention is by no means limited thereto. For example, a spacer between the center block and bottom punch or any other means that can adjust the vertical position of the bottom punch and withstand the U-ing load can serve the purpose. The punch width 2B can be changed by using center blocks of different widths. A minor change of the U-ing punch width 2B can be accomplished by inserting spacers between the side punches 32 and center block 34.

The following are examples of the application of the process according to this invention.

Example I (Crimping Operation)

Steel plate of API X-65 grade, 32 mm thick, was fabricated into pipe with a 42-inch (1066.8 mm) diameter under different crimping conditions shown in Tables 1 and 2, and the same U-ing and O-ing conditions. Table 2 lists the shape of and gap in the workpiece, equivalent and required O-ing load ratios. The equivalent O-ing load ratio means the ratio of the O-ing load needed for obtaining a final shape equivalent to item No. 7 according to this invention in Table 2 to the O-ing load for No. 7. The larger the ratio, the larger will be the O-ing load required. The required O-ing load ratio is the ratio based on the fabrication load required for obtaining a good workpiece shape under item No. 8, a typical example of a conventional process, of Table 2. The smaller the ratio, the smaller the O-ing load for obtaining a good-shaped workpiece, and hence the higher the O-ing efficiency. Also preferred are the smaller peaking p, the smaller diameter of an inscribed circle, which is associated with less out-of-roundness, and the presence of a gap.

TABLE 1

| | Crimping Conditions | |
|---|---|---|
| Description | A(One-Point Contact) | B (Conventional) |
| Radius of Top Die ($R_U$) | 15" (381 mm) | 15" (381 mm) |
| Radius of Bottom Die ($R_L$) | 18" (457 mm) | 15" (381 mm) |

TABLE 1-continued

| Description | Crimping Conditions A(One-Point Contact) | B (Conventional) |
|---|---|---|
| Dies Structure | See FIG. 6. | See FIG. 3. |

Note.
U-ing punch dimensions:
Width 2B = 813 mm
Height H = 324 mm a wider thickness range. They assure the securing of a satisfactory welding gap in the pipe, too.

As will be understood from the above, specification of crimping conditions results in the production of a good-shaped workpiece, having little peaking and out-of-roundness, under a low fabricating load.

Example II (U-ing Operation)

Figure 13:
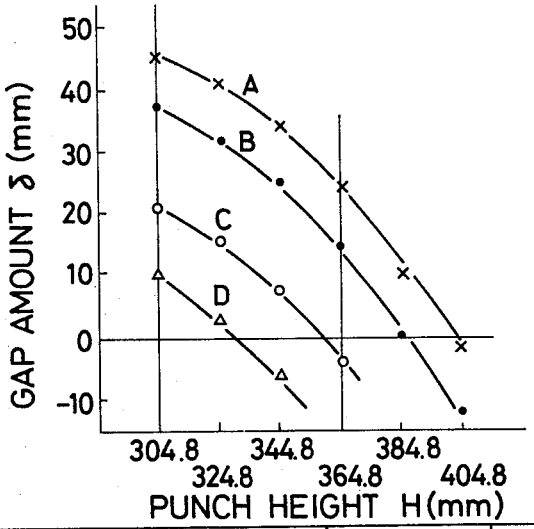
FIG. 13 shows graphically the relationship between the U-inch punch height and the gap width according to this invention.

Steel plates with different thicknesses and strengths were crimped in an ordinary way, U-shaped using a U-ing punch according to this invention, and O-shaped. FIG. 13 shows the relationship between the amount of gap δ in the pipe thus obtained and the height H of the U-ing punch. The U-ing punch was of the type that permits varying the height H, as shown in FIGS. 11(a) and 11(b). $R_1=304.8$ mm, $R_2=304.8$ mm (radius at both edges=150 mm), 2A=355.6 mm, 2B=965.2 mm, 2A/2B−0.368. Punch height H=adjustable between 304.8 mm and 404.8 mm (H/2B=0.316 to 0.419). O-ing was performed under the same condition. The O-shaped workpieces all had a good shape.

TABLE 2

| No. | Crimping Dies Structure | Crimping Conditions: Crimping Width L (mm) | Undeformed Zone Width $l_F$ (mm) | Crimping Load Ratio | Workpiece Shape: Peaking Amount P (mm) | Diameter of Inscribed Circle (mm) | Gap | Equivalent O-ing Load Ratio | Required O-ing Load Ratio |
|---|---|---|---|---|---|---|---|---|---|
| 1 | A. (One-Point Contact) | 200 | 56.0 | 0.75 | 3.0 | 973 | Present | 1.15 | 0.91 |
| 2 | | 200 | 48.0 | 0.90 | 2.0 | 977 | Present | 0.95 | 0.75 |
| 3 | | 200 | 43.0 | 1.0 | 1.6 | 982 | Present | 0.85 | 0.67 |
| 4 | | 135 | 48.0 | 1.0 | 2.7 | 974 | Absent | 1.10 | 0.87 |
| 5 | | 170 | 45.0 | 1.0 | 1.8 | 977 | Slight | 0.95 | 0.75 |
| 6 | | 250 | 40.0 | 1.0 | 1.2 | 985 | Present | 0.82 | 0.65 |
| 7 | | 170 | 49.0 | 1.0 | 2.2 | 975 | Slight | 1.0 | 0.79 |
| 8 | B. (Conventional) | 135 | 67.0 | 1.0 | 4.8 | 965 | Absent | 1.27 | 1.00 |
| 9 | | 200 | 59.0 | 1.0 | 3.3 | 969 | Present | 1.20 | 0.94 |
| 10 | | 200 | 43.0 | 1.4 | 1.6 | 980 | Present | 0.85 | 0.67 |
| | Preferable Range | ≧162.5 | ≦51.7 | | | | | | |

Notes:
1 Encircled items satisfy the preferable conditions.
2 Crimping load ratio is the ratio of crimping load based on that for No. 7. The larger the value, the greater the load.
3 Equivalent O-ing load ratio = $\frac{\text{O-ing load required for obtaining workpiece shape equivalent to No. 7}}{\text{O-ing load for No. 7}}$
4 Required O-ing load ratio is the ratio of O-ing load based on that for No. 8 (conventional process). The smaller the value, the lower the O-ing load.

Table 2 shows the following:

(a) Effect of Width $l_F$ of the undeformed zone (comparison among Nos. 1, 2 and 3)

The undeformed zone width $l_F$ greatly affects the amount of peaking. Deviation of $l_F$ from the specified range causes peaking which cannot be corrected by expansion. Excessive correcting strain near the weld lowers the breaking strength of the pipe. An increased $l_f$ increases out-of-roundness, too.

(b) Effect of Crimping Width L

The increased crimping width L insures securing a gap convenient for welding. A comparison of Nos. 3 to 6 discloses a particularly important fact; when the crimping load is the same, the width $l_F$ of the undeformed zone decreases with increasing crimping width L. This indicates that crimping efficiency increases with increasing L: When L is increased under the same crimping load, peaking and out-of-roundness decrease to produce a better pipe shape.

(c) Effect of Crimping Process (Comparison among Nos. 3, 9 and 10, and between Nos. 4 and 8)

The one-point contact crimping process according to this invention insures 30 percent higher crimping efficiency than conventional crimping, providing an equivalent deformed zone width by an approximately 30 percent lower crimping load, or reducing the width of the undeformed zone by approximately 30 percent under the same crimping load.

(d) General

Conditions Nos. 2, 3, 5, 6 and 7, satisfying all requirements of this invention, excel in both the required O-ing load ratio and the crimping load ratio. These conditions permit reducing the two loads by approximately 30 percent, or at least 20 percent. This means that good-shaped pipes can be produced with less press load or in a wider thickness range.

Negative gap amount δ indicates the presence of residual stress that makes the diameter of the O-shaped workpiece smaller than specified. In this case, the butting edge was cut off to remove about 30 mm, and the resulting gap δ' was measured. Then, δ was determined from the equation δ=δ'−30.

As seen in FIG. 13, the gap amount δ varies between 40 and 45, depending on plate thickness and strength and pipe diameter, when the punch height H is fixed. The gap size has a positive or negative value depending on the punch height H.

Table 3 compares the process of this invention with a conventional one, controlling the gap size at 7 mm. The U-ing punch, plate thickness and strength, and pipe diameter are as shown in FIG. 13.

TABLE 3

| Process | Punch Height | Symbol | Gap Size | O-ing Efficiency | Pipe Shape after O-ing |
|---|---|---|---|---|---|
| | | A | 7mm | 1.61 | Good |
| Conventional | H = 304.8 | B | 7mm | 1.43 | Good |

TABLE 3-continued

| Comparison of O-ing Processes Controlling Gap Size at 7 mm | | | | | |
|---|---|---|---|---|---|
| Process | Punch Height | Symbol | Gap Size | O-ing Efficiency | Pipe Shape after O-ing |
| (Punch Height Fixed) | mm | C | 7mm | 1.21 | Good |
| | | D | 7mm | 1.03 | Good |
| | | A | 7mm | 1.27 | Good |
| | H = 364.8 | B | 7mm | 1.15 | Good |
| | mm | C | 7mm | 0.88 | Bad |
| | | D | 7mm | 0.08 | Bad |
| | H = 392.8 | A | 7mm | 1.00 | Good |
| This Invention (Punch Height Varied) | H = 376.8 | B | 7mm | 1.00 | Good |
| | H = 344.8 | C | 7mm | 1.00 | Good |
| | H = 312.8 | D | 7mm | 1.00 | Good |

Note
1. U-ing punch and symbols correspond to those in FIG. 13.
2. O-ing efficiency indicates the ratio of O-ing load based on one employed in FIG. 13. The larger the value, the lower the fabricating efficiency.

Conventionally, gap control has been achieved by controlling the O-ing load. The gap size is increased by decreasing the O-ing load, the vice versa. The conventional process fixing the U-ing punch height H at 304.8 mm succeeded in securing the desired gap size and producing good pipe shape on all items through D. But the desired gap size (7 mm) was secured only by applying a higher O-ing load than that was appropriate for the pipe specification, since the latter load resulted in larger gaps as shown in FIG. 13. This sharply lowers the O-ing efficiency (or calls for an extremely high O-ing press capacity), as will be readily understood from a comparison of items A made by the conventional process and those made according to this invention in Table 3.

The conventional process fixing the U-ing punch height at 364.8 mm, operated with the an O-ing load appropriate for the pipe specification, resulted in larger gaps for items A and B, and smaller gaps for items C and D, as shown in FIG. 13. In the case of items A and B, the desired gap size and good shape could be obtained by increasing the O-ing load, but with lower O-ing efficiency than in the process of this invention, as shown in Table 3. In the case of items C and D, the gaps must be increased by lowering the O-ing load. The decreased O-ing load, however, results in increased out-of-roundness after O-ing, and thus in off-specification pipes, as shown in Table 3. This means that items C and D cannot be finished into pipes. As a consequence, the conventional process with H=364.8 mm is applicable only to a very limited range of plate thickness and strength and pipe diameter, with a very low fabricating efficiency.

As is evident from Table 3, the conventional O-ing process has a low in efficiency and has very limited application.

By contrast, the process of this invention can easily bring the gap size into the desired narrow range (e.g., 5 to 10 mm) for a wide range of plate thicknesses and strengths and pipe diameters without changing the O-ing conditions, by adjusting the ratio H/2B by changing of the punch height H, as shown in Table 3. Besides, this process permits fixing the O-ing conditions, or selecting the appropriate O-ing load, taking into account the pipe shape after O-ing alone. All this leads to excellent circular workpiece shape after O-ing and high O-ing efficiency.

In addition to the examples in FIG. 13, many experiments were performed on heavy wall UO pipes with various strengths and sizes, using various U-ing punches falling within the ranges of $0.65 \leqq 2(B+t) \leqq 0.93$ and $0.22 \leqq 2A/2B \leqq 0.42$. It was confirmed that the effect of this invention can be achieved within the range H/2B=0.28–0.45 by decreasing the ratio H/2B for increasing the gap, and vice versa. In this example, the punch height H was changed. The same effect can be obtained by changing the punch width 2B or changing both H and 2B.

Figure 14:
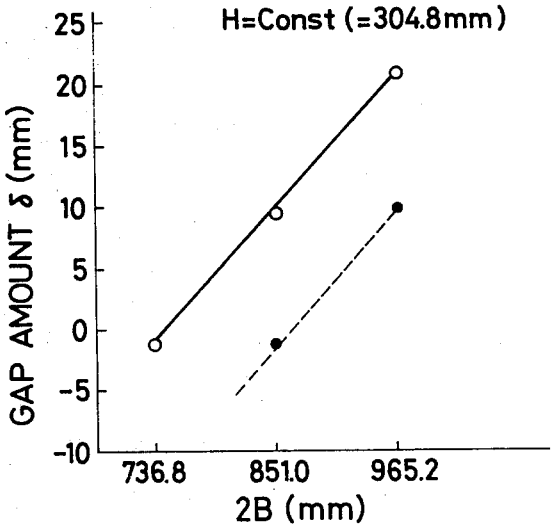
FIG. 14 shows graphically the relationship between the U-ing punch width and the gap width according to this invention.

FIG. 14 shows the relationship between the punch width 2B and the gap size $\delta$ in the U-ing operation according to this invention, when the punch height H is unchanged. This figure shows a tendency that, when the punch height H is fixed, the gap size $\delta$ increases with increasing punch width 2B, and vice versa. This tendency remains the same for all material properties. In practice, changing only the punch height H provides a simpler structure and higher efficiency.

Example III (Combination of Crimping and U-ing Operations)

Steel plate of API X-60 grade, 38 mm thick, was crimped accordiang to the process of this invention, U-shaped using a U-ing punch shown in Table 3, then O-shaped to a workpiece having a diameter of 48-inch (1219 mm). Table 4 shows the shape and gap size of the O-shaped workpiece, too. All items were crimped and O-shaped under the same conditions.

TABLE 4

| | U-ing punch | | | | Shape after O-ing | | |
|---|---|---|---|---|---|---|---|
| No. | 2B | H | 2(B + t)/D | H/2B | Peaking (mm) | Dia. of Inscribed Cycle (mm) | Gap (mm) |
| 11 | 965.2 mm | 362.0 mm | 0.854 | 0.375 | 1.5mm | 1125 | 10 |
| 12 | 736.6 mm | 304.8 mm | 0.667 | 0.414 | 1.5mm | 1118 | 2 |
| 13 | 711.2 mm | 355.6 mm | 0.646 | 0.500 | 1.6mm | 1107 | 0 |

As is evident from Table 4, the U-ing punch shape for item 13 deviates from equation (1). It resulted in elimination of the gap, a smaller inscribed circle diameter and somewhat greater out-of-roundness than items Nos. 11 and 12. But improvement in the peaking amount, the most important feature of this invention, was satisfactory.

Example V (Combination of Crimping and U-ing Operations)

Table 5 shows examples in which the gap size was controlled to between 5 and 10 mm in the fabrication of pipes with various thicknesses, strengths and diameters, changing the height H of the U-ing punch. Crimping was performed within the limits specified by this invention, and O-ing conditions for all items were the same. For the purpose of comparison, the gap size resulted from a U-ing punch height fixed at 362 mm. The U-ing punch used had a structure as shown in FIGS. 11(a) and 11(b) 2B=965.2 mm and $R_1=R_2=304.8$ mm.

TABLE 5

| Symbol | Pipe Dia. D(mm) | Plate Thickness t (mm) | Yield Point (Kg/mm²) | 2(B + t)/D | Gap size δ (mm) H=Fixed at 362mm | Gap size δ (mm) H=Varied |
|---|---|---|---|---|---|---|
| C | 1219.2 | 25.4 | 50.8 | 0.833 | 23 | 8(H=382mm) |
| D | 1219.2 | 32.0 | 48.2 | 0.844 | 15 | 7(H=372mm) |
| E | 1422.4 | 25.4 | 52.4 | 0.714 | 0.5 | 7(H=352mm) |

Table 5 shows that the desired gap size can be obtained easily by changing the punch height H according to this invention.

As described in the foregoing, the crimping process according to this invention permits fabrication with less force, leaving a smaller undeformed zone. This leads to good groove shape after O-ing. The U-ing operation of this invention can easily control the gap size to the desired value, over a wide range of plate thickness and strength and pipe diameter. Unlike the conventional processes, it does not require the changing of the O-ing conditions. Therefore, the O-ing conditions can be fixed at those which are best suited for obtaining the highest degree of pipe roundness, which results in good pipe shape and higher fabrication efficiency. Accordingly, this invention has a great value in the fabriction of heavy wall UO pipes that call for exact gap control.

What is claimed is:

1. A process of fabricating flat steel plate into heavy wall UO pipe by crimping, U-ing and O-ing, wherein the U-ing operation comprises:

using a collapsible U-ing punch comprising a center block carrying paired side punches on both sides and a bottom punch at the bottom thereof; and obtaining the desired butt edge gap in the O-shaped workpiece by decreasing the ratio of the U-ing punch height to the U-ing punch width when the gap is smaller than the desired butt edge gap, and increasing said ratio when the gap is larger than the desired butt edge gap.

2. A fabricting process according to claim 1, wherein said U-ing punch height-width ratio is determined by adjusting the amount the bottom punch projects below the side punches.

3. A fabricting process according to claim 1, wherein said U-ing punch height-width ratio is determined by adjusting the width of the center block.

4. A fabricating process according to claim 1, wherein said U-ing punch height-width ratio falls within the limits of $0.65 \leqq 2(B+t)/D \leqq 0.93$, wherein 2B=punch width (mm), D=pipe outside diameter (mm), and t=material plate thickness (mm).

5. A fabricating process according to claim 1, wherein said U-ing punch height-width ratio falls within the limits of $0.65 \leqq 2(B+t)/D \leqq 0.93$, $0.22 \leqq 2A/2B \leqq 0.42$, and $0.28 \leqq H/2B \leqq 0.45$, wherein 2B=punch width (mm), D=pipe outside diameter (mm), t=material plate thickness (mm), 2A=width of punch height adjusting means (mm), and H=punch height (mm).

6. A fabricating process according to claim 1, wherein the workpiece, other than the edge thereof, is kept out of contact with the bottom die from the start to completion of the crimping operation.

7. A fabricating process according to claim 6, wherein the crimping dies comprise a bottom die having a radius of curvature not smaller than that of the top die.

8. A fabricating process according to claim 6, wherein the crimping dies comprises a bottom die having a radius of curvature smaller than that of the top die.

9. A fabricating process according to claim 6, wherein the workpiece is upheld by a supporting means near the center of the width thereof so that the upper surface of the workpiece edge comes in contact with the working surface of the top die.

10. A fabricating process according to claim 6, wherein the crimping width is not smaller than $0.05\pi(D\text{-}t)$ and the undeformed zone width is not larger than $$\frac{D}{2}\tan\left(\cos^{-1}\frac{D}{D+5}\right),$$

wherein D=pipe outside diameter (mm) and t=material plate thickness (mm).

* * * * *